United States Patent [19]

Vlasich

[11] Patent Number: 4,658,993

[45] Date of Patent: Apr. 21, 1987

[54] METERING DISPENSER FOR VISCOUS COMPOSITIONS

[75] Inventor: Richard J. Vlasich, Fort Worth, Tex.

[73] Assignee: Alcon Laboratories, Inc., Fort Worth, Tex.

[21] Appl. No.: 667,623

[22] Filed: Nov. 2, 1984

[51] Int. Cl.[4] ..... B67D 5/42

[52] U.S. Cl. ..... 222/390; 74/142; 433/89; 433/90

[58] Field of Search ..... 222/390, 391, 386; 74/141.5, 142, 169; 433/89-90, 81; 604/223-224, 227-229, 333; 401/172-174

[56] References Cited

U.S. PATENT DOCUMENTS

| | | | |
|---|---|---|---|
| 1,370,460 | 3/1921 | Little | 222/390 X |
| 2,702,942 | 3/1955 | Michaelis | 222/390 X |
| 2,913,151 | 11/1959 | Wiseman et al. | 222/390 X |
| 3,410,462 | 11/1968 | Donovan | 222/516 |
| 4,189,065 | 2/1980 | Herold | 222/46 |
| 4,416,397 | 11/1983 | Brown | 222/219 |
| 4,421,297 | 12/1983 | Pongrass et al. | 222/516 X |

*Primary Examiner*—Charles A. Marmor

*Attorney, Agent, or Firm*—James A. Arno; Gregg C. Brown; Robert L. Price

[57] ABSTRACT

A dispensing device includes a hollow cylindrical body from which a high viscosity composition is discharged in precisely metered doses by means of a plunger rod longitudinally movable within the body. The plunger rod includes a series of thread segments formed at equispaced, angular intervals from each other to establish an exterior thread of constant pitch in threaded engagement with the body. Each segment has an abutment surface projecting from the surface of the plunger. By depressing a trigger mounted on the body into contact with an abutment surface aligned therewith, the plunger rotates through the angular interval and thereby advances through the body to expel a desired amount of composition. Disengagement of the trigger with the abutment surface automatically occurs as the abutment surface rotates to the end of the angular interval, out of contact with the trigger, causing the next in-line abutment surface to be indexed into alignment with the trigger to allow for successive doses.

7 Claims, 6 Drawing Figures

METERING DISPENSER FOR VISCOUS COMPOSITIONS

TECHNICAL FIELD

The present invention relates generally to dispensing devices and, more particularly, to a dispensing device for metering precise doses of high viscosity or gel-like compositions.

BACKGROUND ART

There exists a need for dispensing in precisely metered amounts various types of high viscosity or gel-like medicinal and dental compositions, such as Pilocarpine which is an anti-glaucoma agent normally dispensed in doses as small as 10 to 15 μl.

One type of dispenser capable of dispensing the aforesaid compositions comprises an elongate hollow body from which the composition can be metered through a closable discharge opening by longitudinally advancing within the body a piston attached to a threaded spindle. The spindle engages a nut mounted on a rear end of the body. A flange provided on the nut has indicia cooperating with an orientation wing mounted to rotate the spindle. The amount of composition to be dispensed is controlled by the user who rotates the wing into registration with one of the indicia displayed on the flange.

As the amount of dispensed composition is controlled by user sight alignment between the orientation wing and indicia, the metering accuracy is dependent on how exact the wing is set to the respective indicia. Accurate metering thus requires careful handling of the device. There is also a chance of the spindle being screwed out of the hollow body due to careless handling, inadvertent actuation or shock, resulting in an amount of composition corresponding to only an incomplete revolution being dispensed during subsequent rotation of the spindle.

Another problem associated with the foregoing device is that one hand is required to rotate the spindle while the other hand holds the body to dispense the composition. Two handed operation can be cumbersome and particularly difficult for arthritic persons.

To accurately dispense a desired amount of high viscosity composition, U.S. Pat. No. 4,189,065 to Herold discloses a dispensing device wherein a hollow cylindrical body containing composition is formed with a stationary detent engageable with a longitudinal groove provided on a threaded spindle to precisely control the degree of angular rotation of the spindle when rotating a knob mounted thereon to dispense the composition. While this type of device provides greater metering accuracy than the aforementioned dispenser, two handed operation is still required to discharge composition, one hand grasping the body while the other hand rotates the knob. Also, since the detent is a resilient member, it is possible for the groove to overtravel slightly past the detent during rotation of the spindle, due to the resiliency of the latter, causing an excessive amount of compositions to be discharged from the dispenser.

It is accordingly an object of the present invention to provide an improved metering dispenser for high viscosity compositions which allows precise metering utilizing simple means.

A further object of the invention is to provide a device achieving exact metering by utilizing a mechanism capable of single-handed operation.

It is another object to provide a device for dispensing high viscosity compositions which precisely controls metering by automatically stopping advancement of a plunger means after a precise amount of composition has been dispensed.

Still a further object is to provide a metering dispenser which is easy to manufacture and safe to handle.

DISCLOSURE OF INVENTION

A device for dispensing high viscosity compositions, in accordance with the present invention, comprises an elongate hollow body having a discharge opening at a front end thereof and a chamber for containing the composition. A plunger rod is threadedly received within the hollow body through a rear end thereof. In response to rotational movement of the plunger rod, a piston is advanced through the chamber to dispense a predetermined amount of composition through the discharge opening. A trigger is fixed to the hollow body for engaging to rotate the plunger rod a predetermined angular interval to advance the plunger within the body for precise metering to occur.

According to one aspect of the invention, the plunger rod is formed with an exterior thread engaging an interior thread formed within the hollow body. The exterior thread is an interrupted thread established by a plurality of thread segments of constant pitch, each extending for a predetermined angular interval along the outer surface of the rod. Each thread segment has a leading end portion defining an abutment surface projecting outward from the surface of the rod. This abutment surface, when positioned in tangential alignment with the trigger which is then depressed into contact therewith, causes the plunger to rotate through the angular interval, advancing the piston within the chamber.

Preferably, the trigger includes a longitudinal lever arm attached to an outer surface of the body. An opposite end of the lever supports an actuating arm extending in tangential alignment with an in-line abutment surface of one of the thread segments. Depressing of the opposite end causes the actuating arm to engage the abutment surface, inducing co-rotation of the plunger rod about its longitudinal axis through the predetermined angular interval until the actuating arm disengages from the abutment surface. Automatic disengagement of the actuating arm with the surface occurs by virtue of angular displacement of the surface out of the plane of travel of the actuating arm. This disengagement occurs when the abutment surface has travelled through the predetermined angular interval, assuring precise metering of the composition through the discharge opening of the hollow body.

In accordance with another aspect of the invention, the leading end of each thread segment has a first major diameter and a trailing end thereof has a second major diameter which is less than the first diameter. The thread major diameter along the length of each thread segment progressively decreases from the first to the second diameter. The trailing end portion of each thread segment is thereby a reduced diameter portion relative to the leading end portion. The reduced diameter portion is angularly positioned to provide a clearance enabling the actuating arm to be depressed into contact with the in-line abutment surface. With this arrangement, the outer surface of the leading end portion of the next in-line thread segment acts as a cam surface, advancing to disengage the actuating arm from the in-line abutment surface as the latter rotates to the end of the predetermined angular interval.

The interrupted exterior thread of the plunger rod is preferably of constant pitch along the entire length of the rod to provide smooth threaded engagement with the interior thread of the hollow body. Furthermore, the exterior thread has a predetermined pitch so that a plurality of abutment surfaces associated with their respective thread segments are established at equispaced angular intervals from each other in a common cross-sectional plane extending through the plunger rod. By appropriately selecting the pitch, when one thread segment is rotated through the predetermined angular interval by the actuating arm, the abutment surface of the next in-line thread segment is indexed into operative position to provide a successive dose of composition.

Still other objects and advantages of the present invention will become readily apparent to those skilled in this art from the following detailed description, wherein I have shown only the preferred embodiments of the invention, simply by way of illustration of the best mode contemplated by me for carrying out my invention. As will be realized, the invention is capable of modifications in various aspects, all without departing from the invention. Accordingly, the drawing and description are to be regarded as illustrative in nature, and not as restrictive.

BEST MODE FOR CARRYING OUT THE INVENTION

Figure 1:
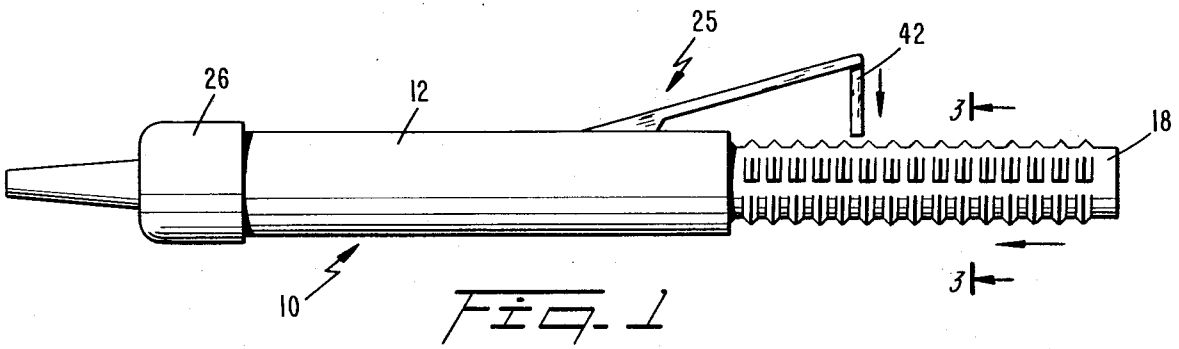
FIG. 1 is a side elevational view of a metering dispenser for high viscosity compositions in accordance with the present invention.
Figure 2:
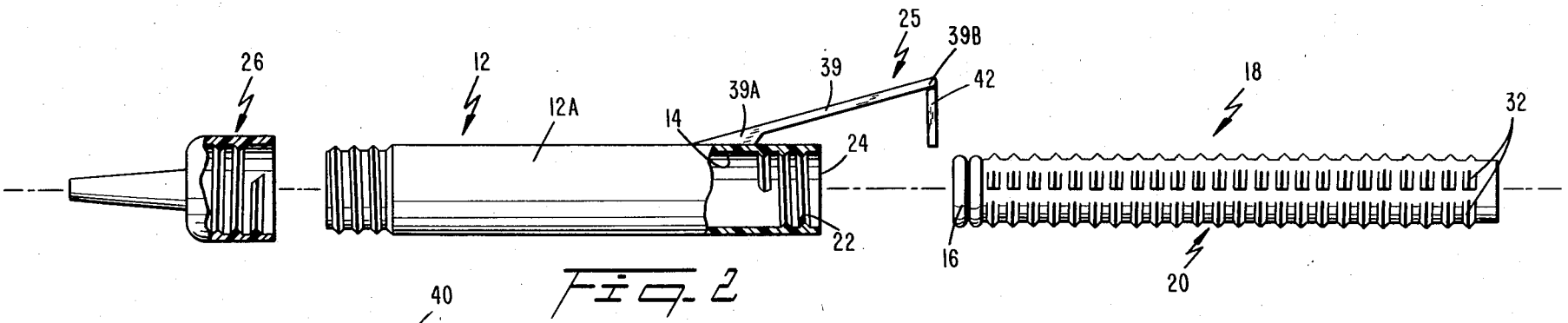
FIG. 2 is an exploded, partial sectional view of the various components of the invention in FIG. 1.

Referring to FIGS. 1 and 2, metering dispenser 10 of the invention comprises a hollow cylindrical body 12 having a chamber 14 in which a gel-like composition is contained. A piston 16 slidable within chamber 14 is fixed to the front end of a plunger rod 18. The rod 18 has an exterior thread 20 engaging internal threads 22 within chamber 14 adjacent a rear opening 24 thereof. The composition is dispensed in precisely metered quantities through an applicator tip 26 threaded to the front end of body 12 by incrementally advancing piston 16 within the chamber in response to rotation of rod 18 about its longitudinal axis. Manual rotation of rod 18 through a constant predetermined angular interval is accomplished in the unique manner described more fully below by depressing a trigger 25 into contact with plunger 18.

Figure 3:
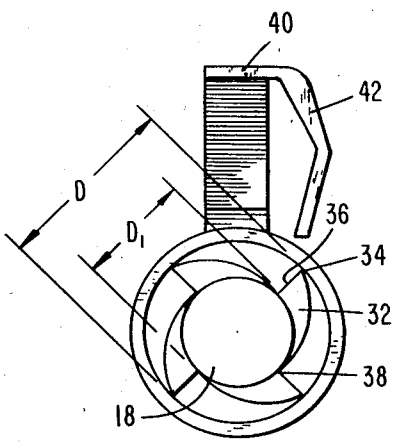
FIG. 3 is a sectional view taken along the line 3—3 of FIG. 1 to show the operative positioning of one thread segment of the plunger rod with respect to the actuating arm of the trigger.

Exterior thread 20 formed on the outer surface of plunger rod 18 extends along the entire length thereof and is of the same pitch as internal threads 22 for smooth threaded engagement therewith. As best shown in FIG. 3, exterior thread 20 is actually a series of identical thread segments 32, each extending along the outer surface of rod 18 for a predetermined angular interval. Each thread segment 32 is formed with a leading end 34 which establishes a flat abutment surface 36 and a trailing end 38 terminating immediately next to the leading end of an adjacent thread segment. The major diameter D of each leading end 34, which constitutes the maximum diameter of exterior thread 20, is slightly less than the corresponding diameter of internal thread 22, assuring smooth, uninterrupted threaded engagement as plunger rod 18 advances into body 12.

Trigger 25 includes a lever arm 39 having one end 39A mounted to the exterior surface 12A of cylindrical body 12. The lever arm 39 is inclined outward from the exterior surface 12A and is co-planar with the longitudinal axis of rod 18 to project rearward beyond opening 24. The opposite end 39B of lever arm 39 is formed with transverse, offset portions 40 (see FIG. 3) from which depends an actuating arm 42 that projects toward plunger rod 18 in tangential alignment with the exterior surface thereof. By depressing opposite end 39B of lever arm 39, actuating arm 42 moves toward rod 18 within the tangential plane to contact the abutment surface 36 of an appropriately positioned thread segment 32 to rotate the rod through the predetermined angular interval and, in this manner, advance piston 16 within chamber 14 to dispense a precisely metered dosage of high viscosity composition through applicator tip 26.

Figure 4:
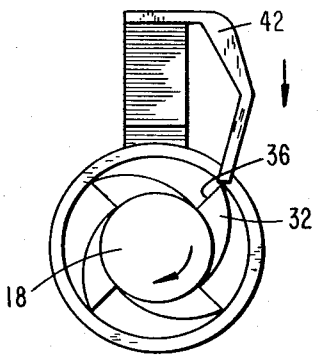
FIG. 4 is a view similar to FIG. 3 showing initial depressing of the trigger into contact with the abutment surface to rotate the plunger rod and thereby longitudinally advance the piston within the hollow body.
Figure 5:
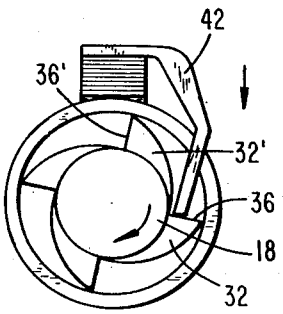
FIG. 5 is a view similar to FIG. 4 showing further rotational displacement of the in-line thread segment when further depressing the trigger.

In the initial, operative position shown in FIG. 3, abutment surface 36 of an in-line thread segment 32 projects through the plane of travel of actuating arm 42 to engage the tip thereof when trigger 25 is initially depressed into the position shown in FIG. 4. As trigger 25 is further depressed, this pressing contact causes abutment surface 36, as shown in FIG. 4, to yield and begin to rotate through the predetermined angular interval, causing co-rotation of plunger rod 18 and advancement of piston 16 within chamber 14 by virtue of the threaded engagement between the rod and cylindrical body 22. As abutment surface 36 of thread segment 32 rotates through the three o'clock position shown in FIG. 5, this surface projects even further through the plane of travel of actuating arm 42, assuring reliable contact therewith. As the abutment surface 36 descends through the intermediate position of FIG. 5 towards its final rest position shown in FIG. 6, the surface begins to withdraw from the plane of travel, causing the tip of arm 42 to move along the surface towards the outer edge. Upon reaching the rest position, meaning that plunger rod 18 has rotated through the predetermined angular interval, the abutment surface 36 withdraws from the plane of travel, causing arm 42 to automatically disengage and resume the position shown in FIG. 3.

In accordance with the invention, actuation of trigger 25 for precise metering of composition is easily accomplished by the user with one hand, simply by wrapping the palm and fingers of the hand (not shown) around cylindrical body 12 so that a finger rests upon lever arm 39 to depress the trigger by application of slight pressure. This allows the invention to dispense certain compositions, such as Pilocarpine, directly onto desired areas of body (e.g., the eyes). Since arm 42 automatically disengages from the abutment surface 36 once rod 18 rotates through the angular interval and because the amount of composition dispensed with each partial rotation of the plunger is defined by the constant inner diameter of body 12 and the constant pitch of thread 20, dispensing of an accurately metered amount of composition is always assured.

Figure 6:
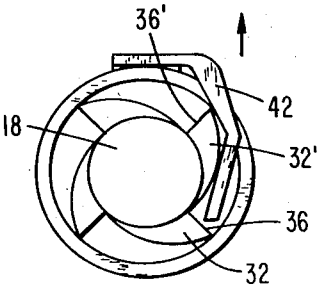
FIG. 6 is a view similar to FIG. 5 showing disengagement of the trigger from the in-line thread segment as the associated abutment surface rotates out of the plane of travel of the trigger.

As the in-line abutment surface 36 is rotated with trigger 25 to its FIG. 6 rest position, it will be appreciated that the next in-line abutment surface 36' automatically co-rotates into the initial in-line position shown in FIG. 3, thereby permitting successive doses of composition to be dispensed through applicator tip 26.

Furthermore, as the in-line abutment surface 36 rotates through the angular interval in the manner set forth above, this surface will also advance longitudinally in the direction of hollow body 12 by virtue of the thread pitch. To prevent inadvertent disengagement between abutment surface 36 and actuating arm 42, the arm has sufficient resilience to twist slightly with respect to offset portion 40 of the trigger, so that the top of the actuating arm can advance with the abutment surface in the longitudinal direction, assuring reliable contact therewith.

As shown in FIG. 3, the trailing end 38 of each thread segment 32 preferably has a major diameter $D_1$, corresponding generally to the diameter of plunger rod 18, so that the major diameter of the thread segment decreases progressively along the length of the segment from D to $D_1$. In this manner, the trailing end portion of each segment 32 is a reduced diameter portion relative to the leading end portion. The reduced diameter portion of each thread segment 32 provides a clearance enabling actuating arm 42 to be depressed into contact with abutment 36 to rotate same through the angular interval without interference from a next in-line thread segment as it rotates into the in-line position. Furthermore, as the in-line thread segment 32 is depressed from its intermediate FIG. 5 position to the FIG. 6 rest position, the leading end portion of the next in-line segment 32' begins to contact the actuating arm and acts as a camming surface that assures disengagement of the arm from the abutment surface as the latter rotates to the end of the angular interval. This camming release mechanism is of particular importance in the event that the tip of actuating arm 42 "sticks" to abutment surface 36 since this sticking might possibly cause the abutment surface to travel past the FIG. 6 rest position.

In this disclosure, there is shown and described only the preferred embodiment of the invention, but, as aforementioned, it is to be understood that the invention is capable of changes or modifications within the scope of the inventive concept as expressed herein. Accordingly, it is intended that the scope of the invention be defined by the claims appended hereto.

I claim:

1. A device for dispensing predetermined doses of high viscosity compositions, comprising:

(a) an elongate hollow body having a discharge opening at a front end thereof and an interior region for containing said composition;

(b) plunger means threadedly received within said hollow body for dispensing said composition through the front end in response to rotational movement of said plunger means causing the plunger to longitudinally advance through the body; and (c) trigger means fixed to said hollow body for engaging with and to rotationally displace said plunger means a predetermined angular interval to thereby advance the plunger within the body, causing a precisely metered amount of composition to be dispensed through the discharge opening, wherein said plunger means includes a rod having an exterior thread engaging an interior thread formed within the body and a piston mounted on a forward end of the rod within the interior region, said exterior thread being an interrupted thread established by a plurality of thread segments, wherein each thread segment extends for a predetermined angular interval and includes a first or leading end defining an abutment surface engageable with the trigger means to rotate the plunger means when the trigger means is depressed into contact therewith, and wherein said trigger means includes a lever arm having one end attached to an outer surface of the hollow body and an opposite end projecting rearward beyond the rear end of said body, said opposite end carrying an actuating arm extending tangentially for alignment with an abutment surface of one of said thread segments when the plunger means is inserted into the body, whereby the pressing of said opposite end causes the actuating arm to engage the abutment surface and rotate the plunger rod about its longitudinal axis for said predetermined angular interval until the actuating arm disengages from said abutment surface.

2. The device of claim 1, wherein said leading end of each thread segment has a first major diameter D and a second or trailing end thereof has a second major diameter $D_1$, where $D > D_1$, and the thread major diameter along length of the thread segment progressively decreases from D to $D_1$, wherein a trailing end portion of each thread is thereby a reduced diameter portion relative to the leading end portion, the reduced diameter portion being angularly positioned to establish a clearance enabling the actuating arm to be depressed into contact with an abutment surface aligned with said arm.

3. The device of claim 2, wherein the leading end portion of each thread segment has an outer surface that acts as a cam surface, when the associated abutment surface is in a next-in-line position for radial alignment with the actuating arm, that urges the actuating arm off the in-line abutment surface as the latter rotates to the end of the predetermined angular interval.

4. The device of claim 1, wherein said exterior thread has a predetermined constant pitch so that a plurality of abutment surfaces associated with their respective thread segments are established at equispaced angular intervals from each other in radially common cross-sectional planes extending through the plunger rod.

5. The device of claim 4, wherein said plurality of abutment surfaces in each cross-sectional plane are spaced about 90° from each other.

6. The device of claim 1, wherein said trigger means is resiliently movable with respect to the plunger means to automatically return to a stationary position after being pressed into contact with one of the thread segments.

7. The device of claim 1, wherein the free end of the actuating arm is bent towards the plunger rod.

* * * * *